US011399633B2

(12) United States Patent
James

(10) Patent No.: US 11,399,633 B2
(45) Date of Patent: Aug. 2, 2022

(54) ADJUSTABLE MATTRESS

(71) Applicant: HMC I.P. Holdings Inc., Woodbridge (CA)

(72) Inventor: Michael E. James, Aurora (CA)

(73) Assignee: HMC I.P. Holdings Inc., Woodbridge (CA)

( * ) Notice: Subject to any disclaimer, the term of this patent is extended or adjusted under 35 U.S.C. 154(b) by 0 days.

(21) Appl. No.: 16/354,965

(22) Filed: Mar. 15, 2019

(65) Prior Publication Data

US 2019/0281992 A1 Sep. 19, 2019

Related U.S. Application Data

(60) Provisional application No. 62/643,239, filed on Mar. 15, 2018, provisional application No. 62/643,249, filed on Mar. 15, 2018.

(51) Int. Cl.

| | |
|---|---|
| ***A47C 27/00*** | (2006.01) |
| ***A47C 27/06*** | (2006.01) |
| ***A47C 27/05*** | (2006.01) |

(52) U.S. Cl.

CPC ..... *A47C 27/002* (2013.01); *A47C 27/053* (2013.01); *A47C 27/06* (2013.01)

(58) Field of Classification Search

CPC ..... A47C 27/00; A47C 27/002; A47C 27/04; A47C 27/05; A47C 27/053; A47C 27/06; A47C 27/061; A47C 23/005

See application file for complete search history.

(56) References Cited

U.S. PATENT DOCUMENTS

| | | | | |
|---|---|---|---|---|
| 6,088,859 | A * | 7/2000 | Cavazos | A47C 27/05 5/737 |
| 6,272,701 | B1 * | 8/2001 | Zafiroglu | D04B 21/202 5/497 |
| 9,635,952 | B1 * | 5/2017 | Anthony | A47C 27/121 |
| 2002/0078509 | A1 * | 6/2002 | Williams | A47C 23/005 5/722 |
| 2008/0078029 | A1 * | 4/2008 | Seago | A47G 9/0246 5/497 |
| 2009/0183314 | A1 * | 7/2009 | Demoss | A47C 27/062 267/153 |
| 2011/0131733 | A1 * | 6/2011 | O'Reagan | A47C 27/002 5/737 |
| 2012/0102657 | A1 * | 5/2012 | Wildeman | A47C 31/001 5/698 |
| 2012/0284928 | A1 * | 11/2012 | Henderson | A47C 27/053 5/717 |
| 2012/0291205 | A1 * | 11/2012 | Page | A47C 27/05 5/724 |

(Continued)

*Primary Examiner* — Peter M. Cuomo
*Assistant Examiner* — George Sun
(74) *Attorney, Agent, or Firm* — McNees Wallace & Nurick LLC

(57) ABSTRACT

An adjustable mattress may have an inner spring core between a top and bottom cover. The bottom cover may have at least one section made of a stretchable material that stretches around the mattress as it bends. The stretchable cover reduces the stress on the inner core for the bending when adjusting the mattress. The inner core may be formed from a spring array surrounded by a foam perimeter rail. Sides of the foam perimeter rail may be formed from individual foam coils.

14 Claims, 10 Drawing Sheets

(56) References Cited

U.S. PATENT DOCUMENTS

| | | | | |
|---|---|---|---|---|
| 2013/0212809 | A1* | 8/2013 | Scarleski | A47C 31/105 5/737 |
| 2014/0165292 | A1* | 6/2014 | Gladney | A47C 27/064 5/717 |
| 2015/0096127 | A1* | 4/2015 | Schiller | A47C 27/15 5/717 |
| 2015/0182034 | A1* | 7/2015 | Liran | A47C 27/086 5/655.4 |
| 2015/0296994 | A1* | 10/2015 | Mikkelsen | A47C 21/046 5/655.4 |
| 2016/0213175 | A1* | 7/2016 | Melcher | A47C 20/02 |
| 2017/0318977 | A1* | 11/2017 | Rawls-Meehan | A47C 20/041 |
| 2018/0049559 | A1* | 2/2018 | Jewett | A47C 27/064 |
| 2018/0078048 | A1* | 3/2018 | Pearce | A47G 9/04 |
| 2018/0168362 | A1* | 6/2018 | Dorfman | A47C 27/124 |
| 2019/0029438 | A1* | 1/2019 | Moon | A47C 31/006 |
| 2019/0216226 | A1* | 7/2019 | Theosabrata | A47C 27/084 |
| 2019/0246803 | A1* | 8/2019 | Jewett | A47C 27/062 |

* cited by examiner

ADJUSTABLE MATTRESS

RELATED APPLICATIONS

The current application claims priority to U.S. provisional patent application 62/643,239 entitled "ADJUSTABLE MATTRESS", filed Mar. 15, 2018, as well as U.S. provisional patent application 62/643,249 entitled "ADJUSTABLE MATTRESS", filed Mar. 15, 2018, which are incorporated by reference in their entirety.

TECHNICAL FIELD

The current disclosure relates to mattress constructions and in particular to adjustable mattress constructions for adjustable mattresses.

BACKGROUND

Mattresses are generally formed from an inner core, which may be made of springs or other supporting material. Inner cores of coil springs may be attached to top and bottom covers. The covers may be made from a foam or latex material that provides support for the coil springs as well as providing additional comfort. The covers may include a fabric covering that is made from a non-stretchable material.

Mattresses may rest on a flat platform, or may be placed on a moveable support frame that allows the mattress to be adjusted for comfort, such as by raising the head and feet portions of the mattress. As the mattress is adjusted, for example by raising a head or foot portion of the mattress, portions of the mattress bends. The covers of the inner core do not stretch, and so as the mattress is adjusted, the covers may become tight around locations of the inner core that are bending, thereby compressing the inner core as it bends. While the encasing coverings allow the mattress to bend, they can cause additional forces to be applied as the mattress bends, which may reduce the adjustability of the mattress, increase wear and tear on the mattress as well as change the tension on the springs which may change the comfort of the mattress as it is adjusted.

An additional, alternative and/or improved mattress structure suited for adjustable mattresses is desirable.

BRIEF DESCRIPTION OF THE DRAWINGS

Further features and advantages of the present disclosure will become apparent from the following detailed description, taken in combination with the appended drawings, in which.

DETAILED DESCRIPTION

Figure 1:
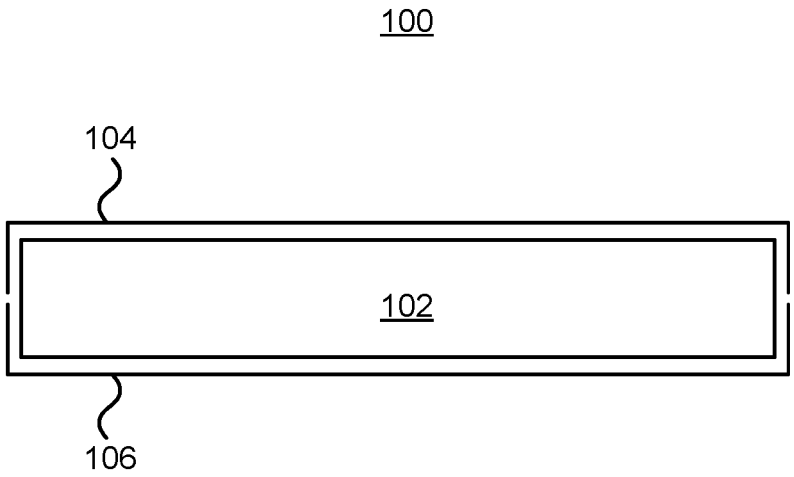
FIG. 1 depicts a front view schematic of a mattress.

In accordance with the present disclosure there is provided an adjustable mattress for an articulating bed frame, the adjustable mattress comprising: an inner core; a top cover attached to a top surface of the inner core; and a bottom cover attached to a bottom surface of the inner core, the bottom cover having at least one section formed of a stretchable material to stretch around the inner core as the adjustable mattress bends.

In a further embodiment of the adjustable mattress, the stretchable material comprises a blend of non-stretchable fibers and stretchable fibers, wherein the non-stretchable fibers are selected from the group consisting of cotton, linen, polyester, nylon and acrylic and wherein the stretchable fibers are selected from the group consisting of spandex, rayon, viscose, and elastane.

In a further embodiment of the adjustable mattress, the stretchable material comprises a mixture of cotton fibers and spandex fibers.

In a further embodiment of the adjustable mattress, the stretchable material comprises a mixture of about 60% cotton fibers and 40% spandex fibers.

In a further embodiment of the adjustable mattress, the bottom cover is formed entirely from the stretchable material.

In a further embodiment of the adjustable mattress, the bottom cover is formed from a combination of the stretchable material and non-stretchable material.

In a further embodiment of the adjustable mattress, the bottom cover is formed from two sections of the stretchable material.

In a further embodiment of the adjustable mattress, the bottom cover is formed from three sections of the stretchable material.

In a further embodiment of the adjustable mattress, the top cover has at least one section formed of the stretchable material to stretch around the inner core as the adjustable mattress bends.

In a further embodiment of the adjustable mattress, the inner core comprises: a plurality of coil springs; and a foam perimeter rail surrounding the plurality of coil springs;

In a further embodiment of the adjustable mattress, the plurality of coil springs comprise a plurality of individual pocket coils.

In a further embodiment of the adjustable mattress, the plurality of coil springs comprise at least two sections of coil springs, each of the two sections separated by a spacer.

In a further embodiment of the adjustable mattress, the spacer comprises a plurality of individual foam coils.

In a further embodiment of the adjustable mattress, the foam perimeter rail comprises a plurality of individual sections of foam material providing a flexible perimeter surrounding the plurality of coil springs.

In a further embodiment of the adjustable mattress, the foam perimeter rail comprises perimeter side rails each formed from a plurality of individual foam coils.

In a further embodiment of the adjustable mattress, the foam perimeter rail comprises head and foot sections formed attached between the perimeter side rails.

In accordance with the present disclosure there is provided an inner core for use in an adjustable mattress, the inner core comprising: a plurality of coil springs; and a foam perimeter rail surrounding the plurality of coil springs, the foam perimeter rail comprising: a top section; a bottom section; and a pair of side sections, each attached to the top section and the bottom section and formed from a plurality of individual foam coils.

In a further embodiment of the inner core, the plurality of coil springs comprise a plurality of individual pocket coils.

In a further embodiment of the inner core, the plurality of coil springs comprise at least two sections of coil springs, each of the two sections separated by a spacer.

In a further embodiment of the inner core, the spacer comprises a plurality of individual foam coils.

An adjustable mattress may have a covering attached to an inner coil spring with the covering made of stretchable material. The stretchable covering is able to stretch around the inner coil spring as the mattress is adjusted, such as by raising a head and/or foot portion of the adjustable mattress. Providing a stretchable covering results in less force being applied to the inner coil as it bends, which may reduce wear and tear on the mattress, provide greater adjustability and/or maintain perceived coil stiffness when the mattress is adjusted.

In addition to the stretchable covering, the adjustable mattress may also include an inner core that has improved adjustability. The improved adjustability inner core may be provided by a foam perimeter formed from individual foam coils. Separating the perimeter rail into individual foam coils provides greater flexibility to the inner coil, and so the mattress.

FIG. 1 depicts a schematic of a mattress. The mattress 100 comprises an inner core 102 encased in a top cover 104 and a bottom cover 106. Although the top 104 and bottom 106 covers are depicted as having a side portion to the covers, it will be appreciated that the covers 104, 106 may only cover the top and bottom surfaces of the inner core 102 and a side covering may be attached between the two covers 104, 106. The inner core 102 may be an inner spring core, a memory foam core or a combination of the two.

In order to provide improved adjustability of the mattress 100, the bottom cover 106, and possibly the top cover 104, are made from a stretchable material. The covers may be made from, for example, a blend of approximately 60% cotton and 40% spandex. Other blends of material are possible, and may have from between 30% to 75% non-stretching materials and between 70%-25% stretching materials. The non-stretching materials may be made from a single type of fiber or a blend of two or more different fibers, such as cotton, linen, polyester, nylon, acrylic, etc. The stretching materials may be made from a single type of fiber or a blend of two or more different fibers such as spandex, rayon, viscose, elastane, etc. The material used for the covers may provide stretch in at least the longitudinal direction, that is between the head and foot of the mattress. The stretching material may be a woven or non-woven material. For non-woven materials, the structure of the material itself may provide stretch to the material and as such may have a smaller amount of stretchable fibers compared to woven materials. The covering material may be a relatively heavy material in order to provide sufficient support for the mattress when adhered, or affixed, to the inner coil core. For example, the covering material may have a weight of between about 8 oz./yd$^2$ and 40 oz./yd$^2$, although both lighter and heavier materials may be used depending upon the desired characteristics of the mattress.

Figure 2:
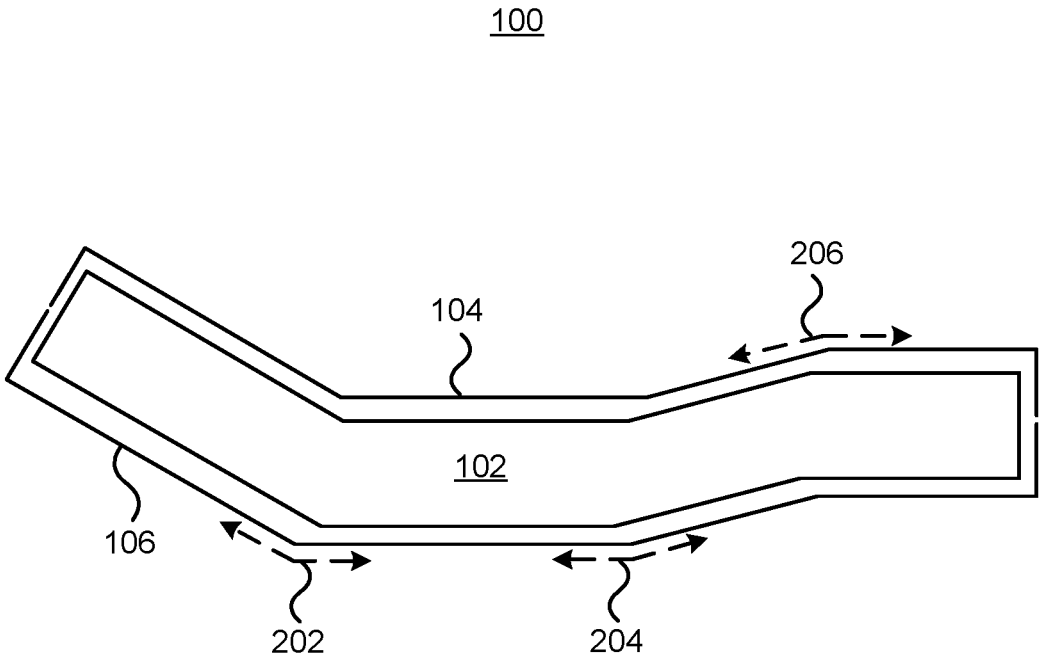
FIG. 2 depicts a side view of a mattress in an adjusted position.

FIG. 2 depicts the mattress of FIG. 1 in an adjusted position. As the mattress 100 bends, the bottom cover 106 stretches at the bend locations, depicted by arrows 202, 204. As described above, the bottom cover 106 is made from a stretchable material that allows the bottom cover to stretch in the longitudinal direction of the mattress. As the mattress bends, the bottom cover 106 stretches about the bend locations 202, 204 and so does not restrict the movement of the mattress or compress the inner core along the bend locations as much compared to a bottom cover made from non-stretching material. As will be appreciated, the mattress will generally bend at a bend location that is transverse to the longitudinal axis of the mattress and as such, having the bottom cover able to stretch in the longitudinal direction provides a less restrictive covering to the bending. An adjustable mattress having a flexible bottom cover that can stretch as the mattress bends provides a mattress with greater flexibility and a greater range of movement without causing the mattress core to be compressed when bending. Similar to the bottom covering 106, the top covering may also be made from a stretchable material in order to stretch around the bend location 206 the mattress 100 is adjusted. While it is possible to provide stretchable coverings for both the top and bottom of the mattress, the bottom will generally have two bend locations, 202, 204 benefiting from the stretchable covering in contrast to the top cover which generally will have one bend location 206. Accordingly, it may be possible to provide an adjustable mattress with only a stretchable bottom cover.

Figure 3:
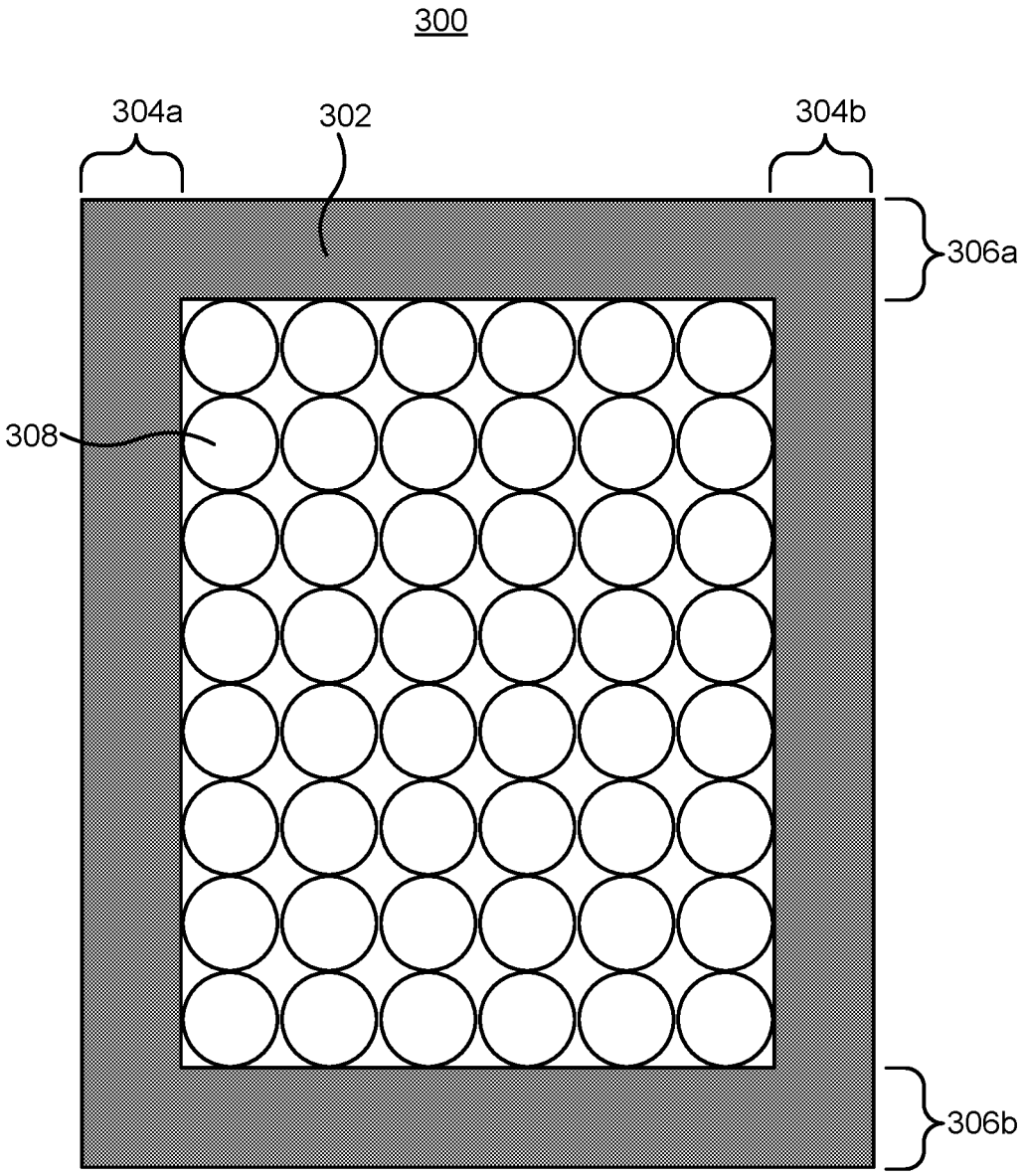
FIG. 3 depicts a schematic of an inner core of a mattress.

FIG. 3 depicts an inner core. The inner core 300 comprises a perimeter rail 302 that may be made from a material such as foam, and has two side sections 304*a*, 304*b* (referred to collectively as side sections 304) joined by a head section 306*a* and foot section 306*b* (referred to collectively as head/foot sections 306). Although the perimeter rail 302 is depicted as being provided by a unitary piece of material, each of the side sections 304 and the head/foot sections 306 may be formed from a respective piece of material that is adhered, or otherwise attached to, adjacent pieces of the perimeter rail.

A coil array 308 is located within the perimeter rail which may comprise a plurality of individual springs or coils 302, which may also be referred to a pocket coils. Although depicted as being provided by pocket coils, the coil array could be provided by a continuous array of coils where all of the springs are formed together. Each individual pocket coil may comprise inner spring or coil that is covered in a sleeve or pocket of material. The pockets or sleeves of adjacent pocket springs are attached, for example by stitching or gluing, to each other. The coil array 308 of pocket coils allows the coils to be attached together, but still move within the respective pockets independently.

The top and bottom surfaces of the inner core 300 are adhered, or otherwise affixed, to the respective top and bottom covers. As described above, the bottom cover, and possibly the top cover, are made of stretchable material, and provide greater flexibility to the mattress. The covers may be attached to the top or bottom surfaces of the perimeter rail 302 as well as the top or bottom surfaces of the coil array. Alternatively, the covers may be attached to only the top or bottom surfaces of the perimeter rail. It will be appreciated that the top and bottom covers may be attached to the respective surfaces of the inner core in different ways. The covers may be made from a single piece of stretchable material or may be made from different pieces of stretchable material joined together in various arrangements. The top and bottom covers attached to the inner core 300 may be the same or different.

Figure 4:
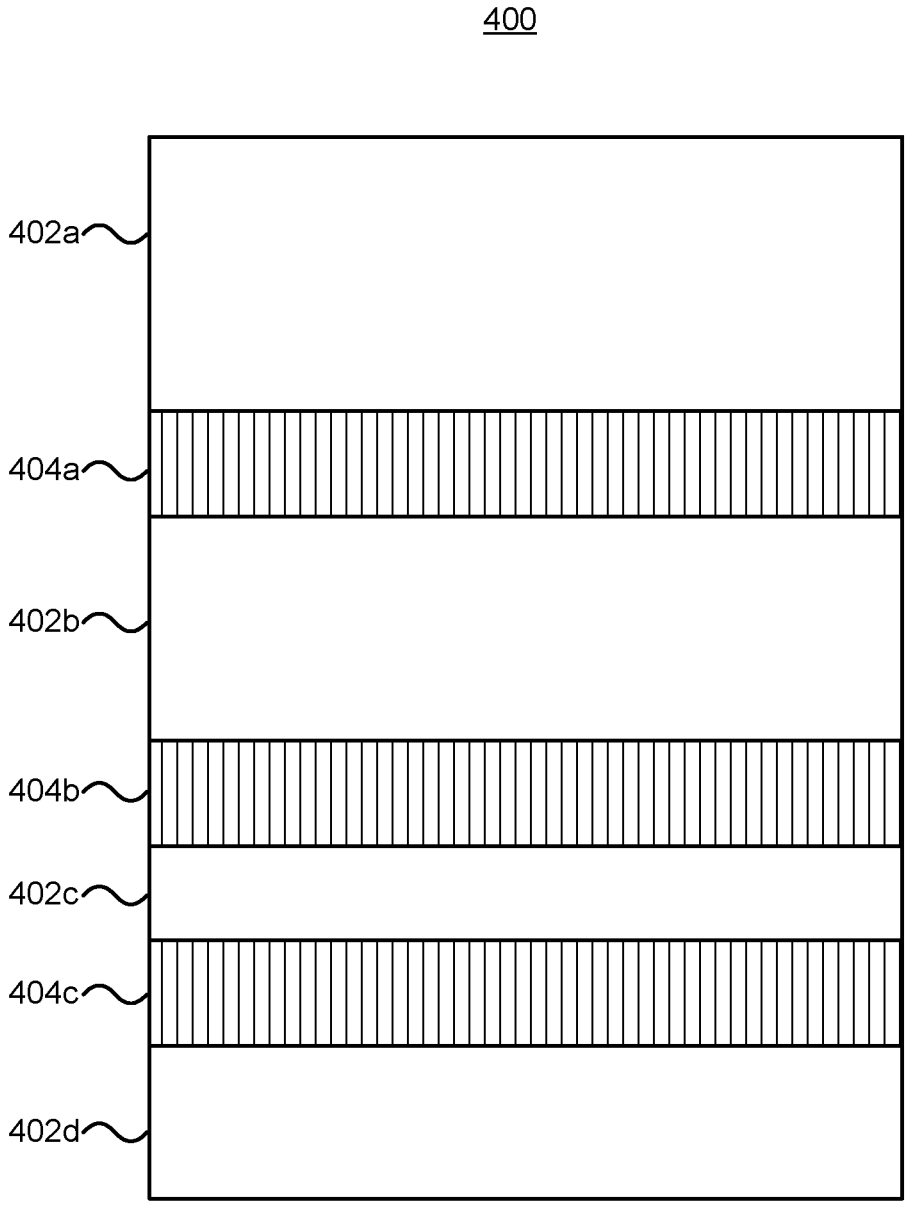
FIG. 4 depicts a schematic of a stretchable cover for a coil inner core.

FIG. 4 depicts a schematic of a stretchable cover for a coil inner core. The stretchable cover 400 may be used as both the top and bottom cover described above. Using the same stretchable cover for the top and bottom of the inner core may allow the mattress to be flipped over. As depicted the cover 400 is made from a number sections of non-stretching material 402*a*, 402*b*, 402*c*, 402*d* (referred to collectively as non-stretching sections 402) joined together by one or more sections of stretching material 404*a*, 404*b*, 404*c* (referred to collectively as stretching sections 404). Each of the non-stretching sections 402 and stretching sections 404 may be the full width of the stretchable cover 400. As depicted, the stretching sections 404 may be located along the length of the cover 400 so as to be arranged over an expected bend location of the mattress, such as bend locations 202, 204, 206 depicted in FIG. 2, regardless of if the cover is on the top or bottom of the inner core. While it is possible to use the same covers for both the top and bottom covers, it is possible for the covers to be different.

Figure 5:
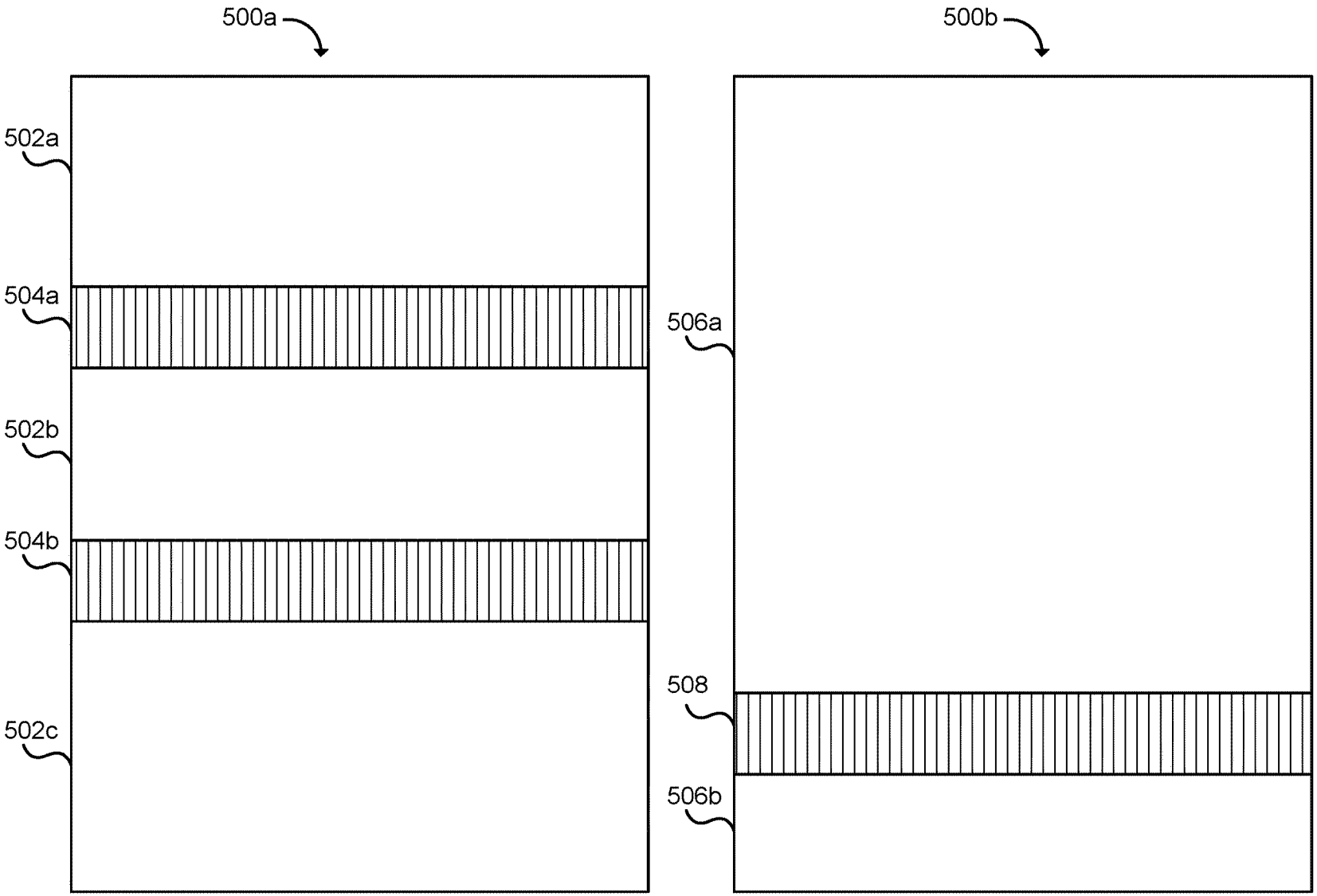
FIG. 5 depicts further schematics of stretchable covers for a coil inner core.

FIG. 5 depicts further schematics of stretchable covers for a coil inner core. As depicted the bottom cover 500*a* differs from the top cover 500*b*. As depicted in FIG. 2, the bottom cover of the mattress may have two bend locations 202, 204 that would benefit from being covered by stretchable material. Accordingly, the bottom cover 500*a* comprises three non-stretchable sections 502*a*, 502*b*, 502*c* (referred to collectively as non-stretchable sections 502) with two stretchable sections 504*a*, 504*c* (referred to collectively as stretchable sections 504) joined between the non-stretchable sections 502. The non-stretchable sections 502 are arranged to cover the bend locations on the bottom of the mattress. As depicted in FIG. 2 the top cover of the mattress may have a single bend location 206 that would benefit from being covered by stretchable material. Accordingly, the top cover 500*b* comprises two non-stretchable sections 506*a*, 506*b*, with a stretchable section 508 joined between them. The stretchable section 508 of the top cover 500*b* is arranged to cover the bend locations on the top of the mattress.

The bottom cover, and top cover if made from a flexible material, or the stretchable sections of the top and bottom covers, is made from a material that can stretch in at least one direction. The material may be a blend of different materials to provide the desired amount of stretching. Further, it is possible to form the bottom cover from a combination of stretching material and woven fabric that does not stretch. That is, the stretchable material may be placed at the locations that the mattress bends with the stretchable sections of material joined together by woven material that does not stretch.

While having a stretchable bottom, and possibly top, cover material helps with improving the flexibility of the mattress, the stiffness of the perimeter rail of the inner core material may make the bending difficult.

Figure 6:
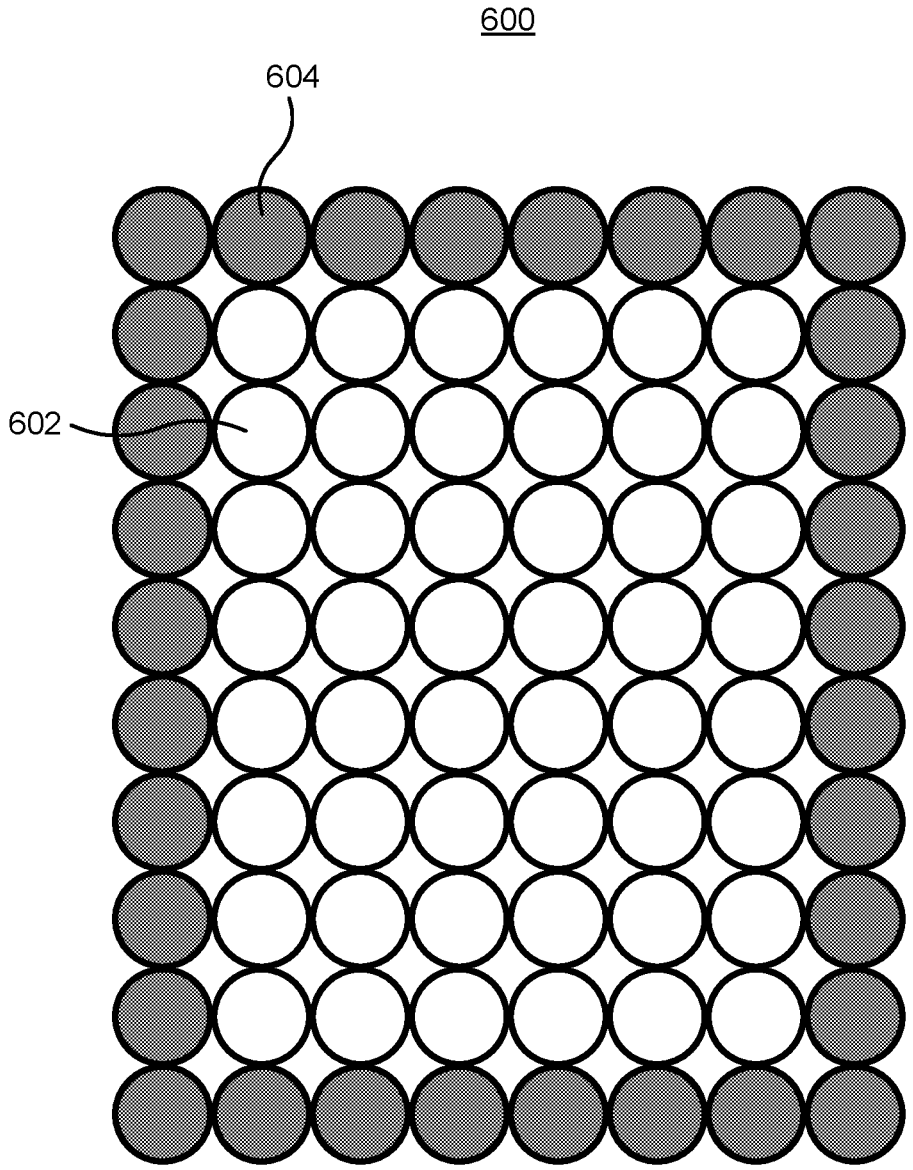
FIG. 6 depicts a schematic of a further inner core of a mattress.

FIG. 6 depicts a further inner core. The inner core 600 may provide greater flexibility in comparison to the inner core 300 providing an ever more flexible adjustable mattress. The inner core 600 comprises a coil array of a plurality of springs or coils 402 surrounded by a perimeter rail. However, in contrast to the perimeter rail 302 of FIG. 3 which is a solid perimeter rail, the perimeter rail is formed from a plurality of individual perimeter foam coils 604. The foam coils 604 may be made from a material similar to that of the perimeter rail material 304, however there are a plurality of individual pieces forming the respective sides and top/bottom of the perimeter rail rather than a single piece as described above. The plurality of individual foam coils may be formed in a similar manner as the pocket coils, with foam material within an outer pocket or sleeve. The individual foam coils may be connected to adjacent coils, such as at a center of the sleeves or pockets, however the bottom and tops of adjacent coils, particularly those located in expected bend locations may remain free from adjacent foam coils in order to provide greater flexibility to the inner core and mattress. The top and bottoms of each individual foam coil of the perimeter rail may be attached to the top and bottom covers.

Figure 7:
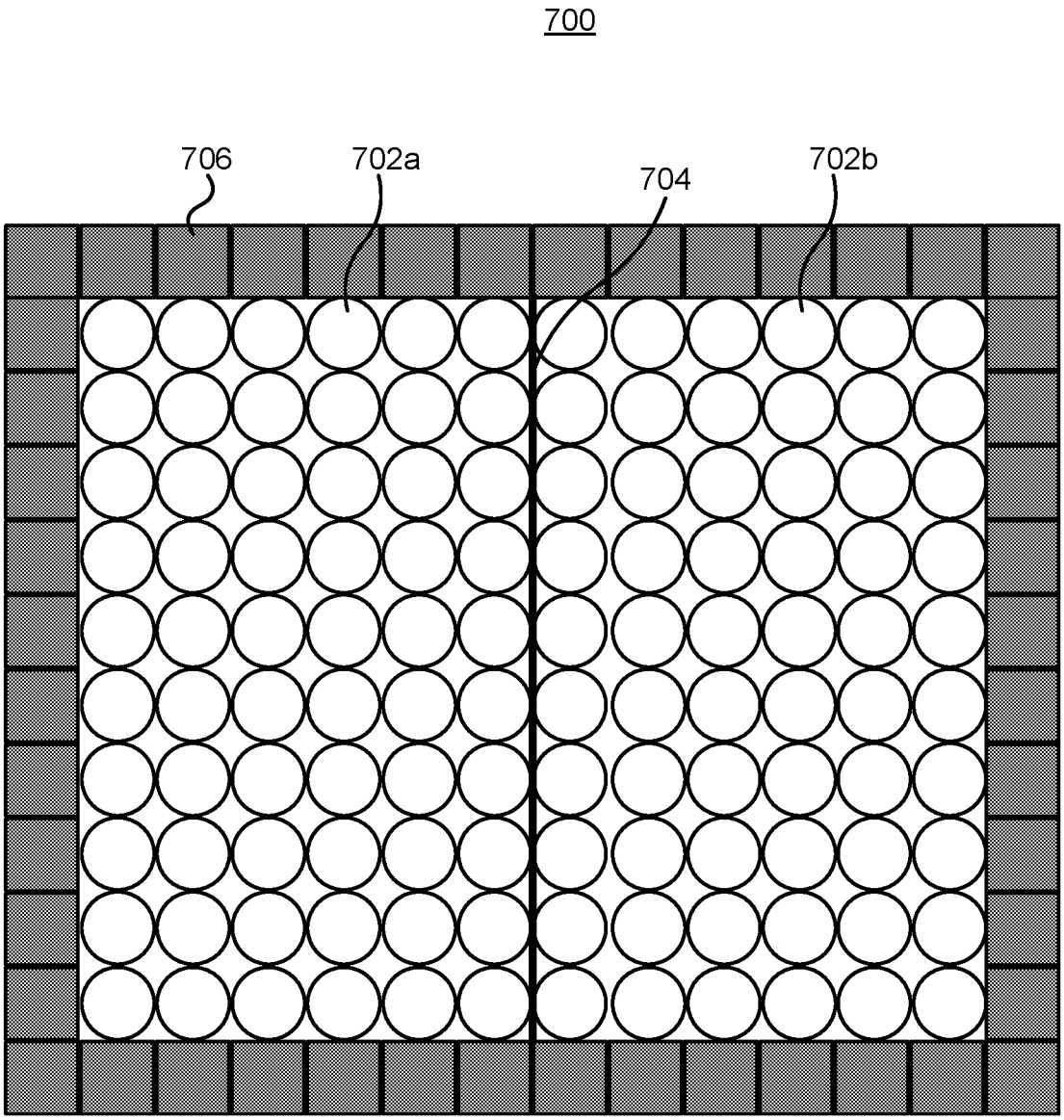
FIG. 7 depicts a schematic of a further inner core of a mattress.

FIG. 7 depicts a schematic of a further inner core of a mattress. The inner core 700 comprises two coil arrays 702*a*, 702*b* (referred to collectively as coil arrays 702). The different coil arrays 702 may provide different support profiles for different portions of the inner core 700. The two coil arrays may be separated by a spacer 704, which may be a piece of material as depicted. The sides of each of the coil arrays 702 may be attached to the spacer 704. The inner core 700 comprises a perimeter rail of individual foam coils 706. As depicted, each individual foam coil 706 may have a rectangular or square shape. The individual foam coils, and in particular the foam coils where the mattress will bend when adjusted, may not be attached to adjacent foam coils. While the foam coils of the sides of the perimeter rail where the mattress bends may not be attached to adjacent foam coils, other foam coils, such as those of the head and/or foot of the perimeter rail, may be attached to adjacent foam coils. The tops and bottoms of each foam coil, as well as the tops and bottoms of the coils of the coil arrays 702, may be attached to the top and bottom covers of the mattress.

Figure 8:
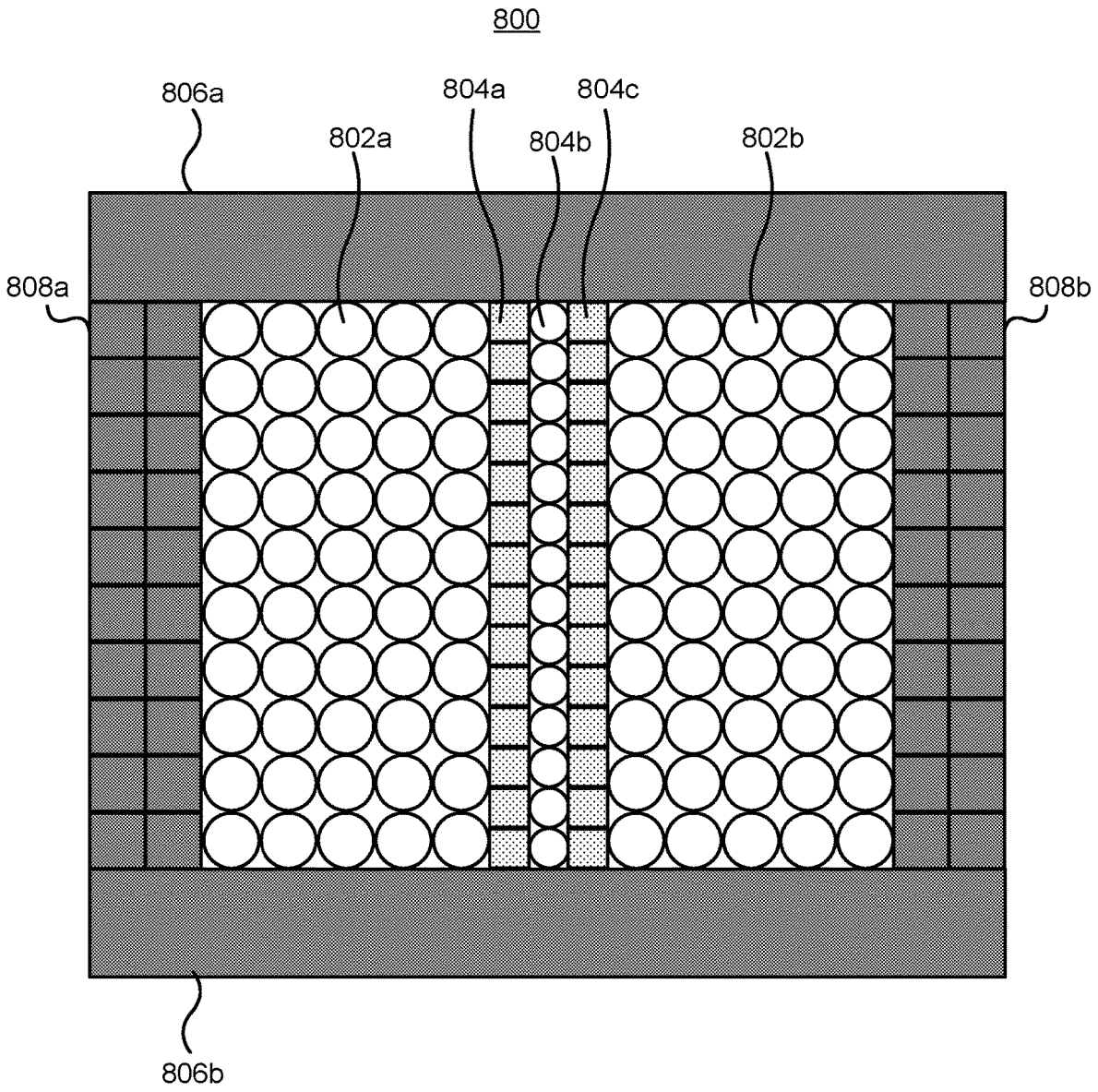
FIG. 8 depicts a schematic of a further inner core of a mattress.

FIG. 8 depicts a schematic of a further inner core of a mattress. The inner core 800 comprises a plurality of coil sections 802*a*, 802*b* (referred to collectively as coil sections 802), each formed from a plurality of pocket coils. The top and bottom surfaces of the coil sections 802 may be attached to top and bottom covers respectively. The coil sections 802 may be separated by a spacer comprising a plurality of elements 804*a*, 804*b*, 804*c* (referred to collectively as spacer 804). The multipart spacer 804 comprises a center section 804*b* formed from a plurality of coils, which may be formed from springs or foam. The multipart spacer 804 further comprises individual foam coils 804*a*, 804*c*, which may have a square, rectangular or round profile, on either side of the inner coils 804*b*. The spacer elements 804*a*, 804*b*, 804*c* may be attached to each other as well as having the top and bottom surfaces attached to the top and bottom covers of the mattress respectively. The inner core 800 comprises a perimeter rail formed from a head rail 806*a* and a bottom rail 806*b* with a pair of side rails 808*a*, 808*b* connected between them. The head rail 806*a* and bottom rail 806*b* may be formed from a plurality of individual foam coils. As depicted, the individual foam coils of the side rails may be formed as a double row of adjacent coils.

Various inner cores of mattress have been described above, which each comprise a foam perimeter rail. The foam may be a relatively higher density foam to provide additional strength to the edges of the mattress where an individual may sit. The foam material may be a polyurethane foam or other similar type of foam material.

Figure 9A:
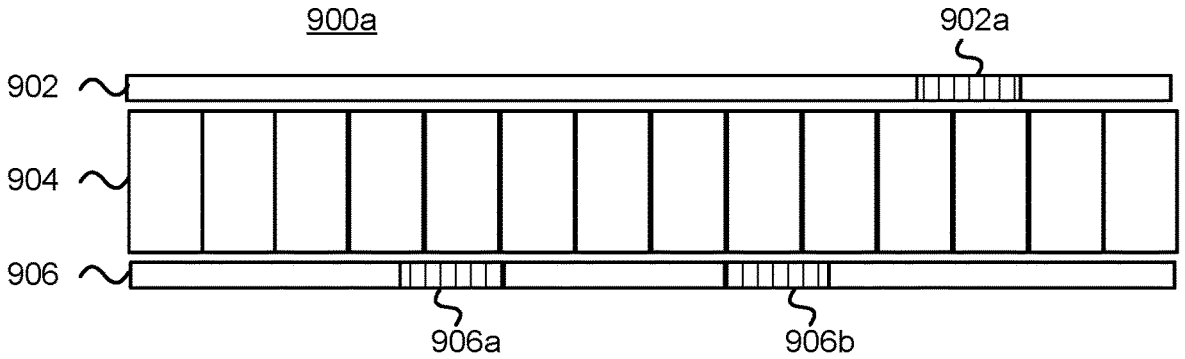
FIGS. 9A-9D depict illustrative mattress constructions for an adjustable mattress.

FIGS. 9A-9D depict illustrative mattress constructions for an adjustable mattress. Each of the mattress constructions depicted in FIGS. 9A-9D comprise a top cover 902 that includes at least one section formed from a stretchable material 902*a*. The top cover 902 is attached to a top surface of an inner core 904. The inner core 904 may have a coil array (not visible in FIGS. 9A-9D) surrounded by a foam perimeter rail. As depicted in FIGS. 9A-9D, the foam perimeter ails may be provided by individual foam coils. The bottom side of the inner core 904 is attached to a bottom cover 906. The bottom cover 906 is depicted as having two or more stretchable sections 906*a*, 906*b* that are arranged where the mattress will bend when it is being adjusted. As depicted in FIG. 9A, a mattress 900*a* may comprise the top cover 902 attached to a top surface of the inner core 904 and a bottom cover 906 attached to a bottom side of the inner core.

Figure 9B:
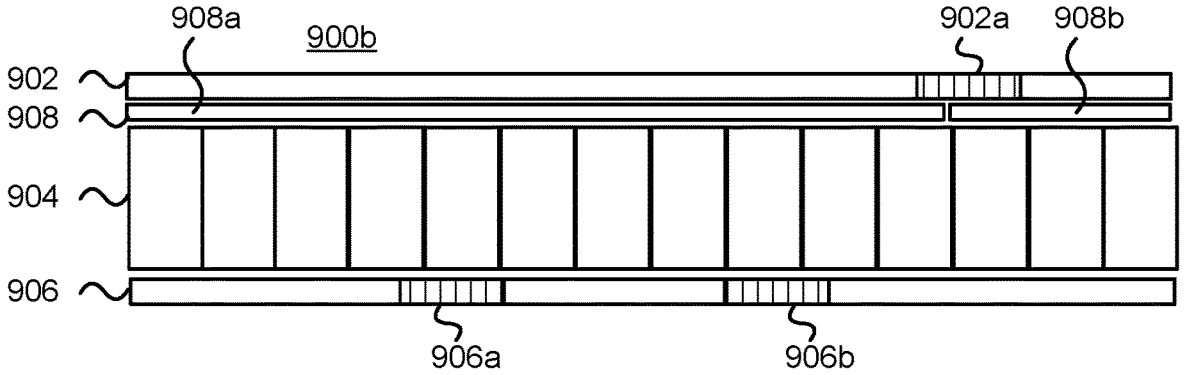

FIG. 9B depicts a further mattress construction. The mattress 900*b* is similar to that described above however, rather than having the top cover directly attached to the inner core 904, an intermediary top layer 908 is attached between the top of the surface of the inner core 904 and the top cover 902. In order to provide the flexibility of the stretchable section of the top cover, the intermediary top layer 908 may be provided by separate sections of material 908*a*, 908*b* that are separated from each other in the vicinity of the bend of the mattress. The intermediary top layer 908 may provide additional strength and/or comfort to the mattress 900*b*.

Figure 9C:
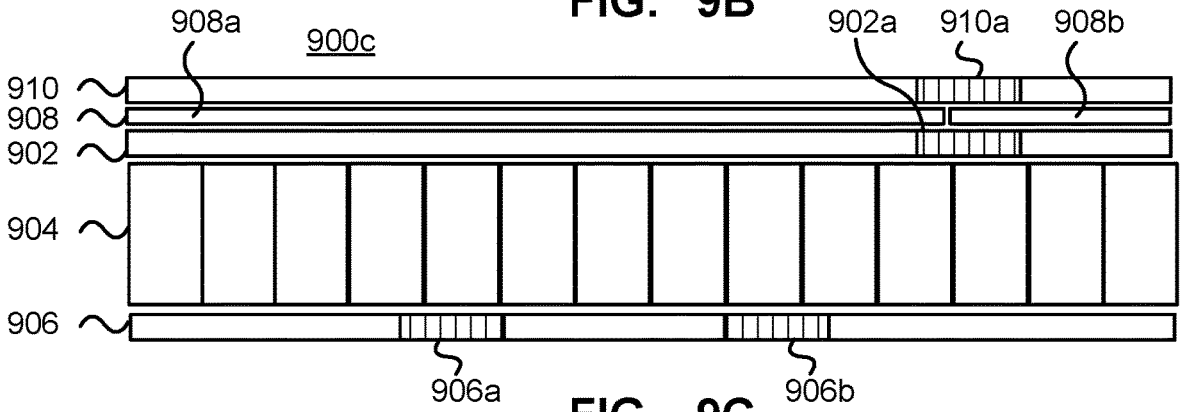

FIG. 9C depicts a mattress constructions 900*c*, which is similar to the mattress construction 900*a* described above and comprises the top cover 902 attached to the top surface of the inner core 904, and the bottom cover 906 attached to a bottom surface of the inner core 904. Additionally, the mattress construction 900*c* further comprises an intermediary top layer 908 formed of two sections 908*a*, 908 as described above. However, in the mattress construction 900*c*, the intermediary layer 908 is between the top cover 902 and a second top cover 910 that includes at least one section of flexible material 910*a*. The flexible section of the second top cover 910 may be aligned with the flexible top section 902*a* of the first top layer 902.

Figure 9D:
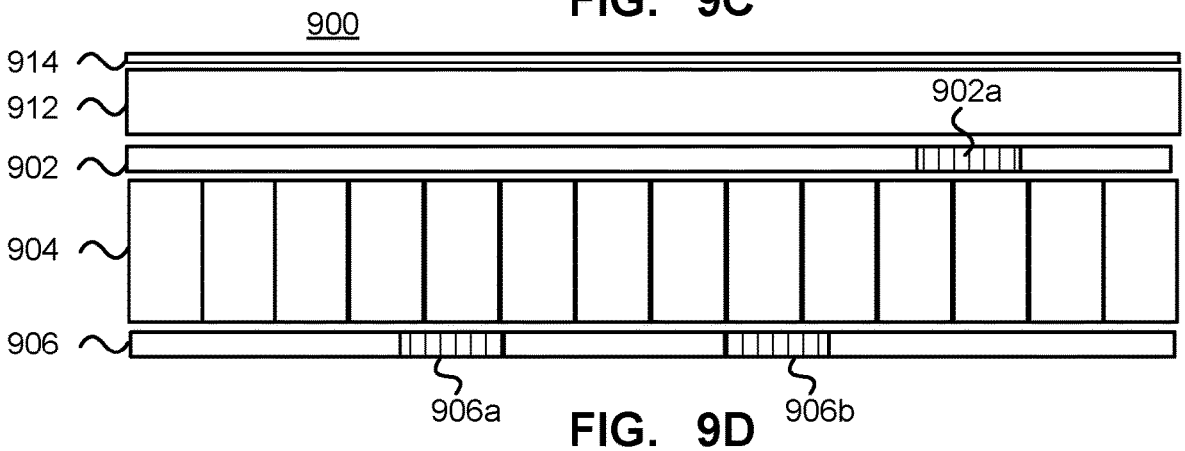

FIG. 9D depicts a mattress constructions 900*c*, which is similar to the mattress construction 900*a* described above and comprises the top cover 902 attached to the top surface of the inner core 904, and the bottom cover 906 attached to a bottom surface of the inner core 904. Additionally, the mattress construction 900*c* further comprises a topper layer 912 formed of easily compressible material, such as for example a pillow layer, covered in a cloth layer 914. The cloth layer 914 may be formed from non-stretchable material, however, since the topper layer is made of an easily compressible material, the cloth layer 914 may not further restrict the flexibility of the top layer 902 having at least one stretchable section 902*a*.

Figure 10:
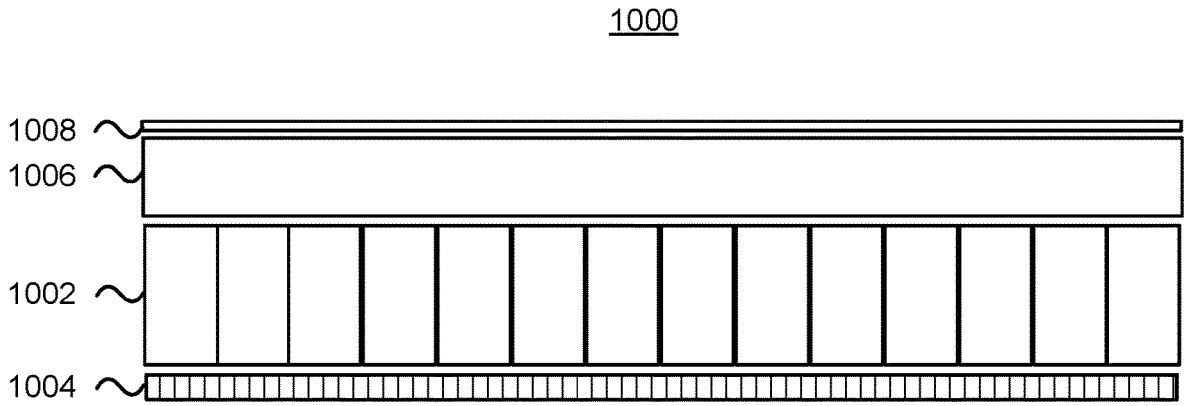
FIG. 10 depicts a further illustrative mattress construction for an adjustable mattress.

FIG. 10 depicts a further illustrative mattress construction for an adjustable mattress. The mattress construction 1000 may be similar to the mattress constructions 900*a*-900*d* described above, however comprises an inner core 1002 attached to a bottom layer 1004 that is formed entirely from stretchable material. Further, unlike the mattress constructions 900*a*-900*d*, which included a top layer 902 having at least one section formed of flexible material, the mattress construction 1000 comprises a top layer 1006 formed by an easily compressible material that can be covered by a cloth layer 1008. The cloth layer 1008 may not have a stretchable section, however, as described above with reference to FIG. 9D, the easily compressible material may allow the inner core 1002 to be easily adjusted.

Although specific embodiments are described herein, it will be appreciated that modifications may be made to the embodiments without departing from the scope of the current teachings. Accordingly, the scope of the appended claims should not be limited by the specific embodiments set forth, but should be given the broadest interpretation consistent with the teachings of the description as a whole.

What is claimed is:

1. An adjustable mattress for an articulating bed frame, the adjustable mattress comprising:

an inner core having head and foot ends and a plurality of sections arranged between the head and foot ends that are adjustable relative to each other by the articulating bed frame;

a top cover attached to a top surface of the inner core; and a bottom cover attached to a bottom surface of the inner core, the bottom cover including:

a plurality of stretchable sections, each formed of a stretchable material to stretch around a respective bending portion of the inner core as the adjustable mattress bends by adjusting the articulating frame, each of the plurality of stretchable sections extending across the inner core perpendicular to a longitudinal axis between the head and food ends; and at least one non-stretchable section formed of a non-stretchable material adjacent to the plurality of stretchable sections, the at least one non-stretchable section covering a non-bending portion of the inner core.

2. The adjustable mattress of claim 1, wherein the stretchable material comprises a blend of non-stretchable fibers and stretchable fibers, wherein the non-stretchable fibers are selected from the group consisting of cotton, linen, polyester, nylon and acrylic and wherein the stretchable fibers are selected from the group consisting of spandex, rayon, viscose, and elastane.

3. The adjustable mattress of claim 2, wherein the stretchable material comprises a mixture of cotton fibers and spandex fibers.

4. The adjustable mattress of claim 3, wherein the stretchable material comprises a mixture of about 60% cotton fibers and 40% spandex fibers.

5. The adjustable mattress of claim 1, wherein the bottom cover is formed from two sections of the stretchable material.

6. The adjustable mattress of claim 1, wherein the bottom cover is formed from three sections of the stretchable material.

7. The adjustable mattress of claim 1, wherein the top cover has at least one section formed of the stretchable material to stretch around the inner core as the adjustable mattress bends.

8. The adjustable mattress of claim 1, wherein the inner core comprises:

a plurality of coil springs; and a foam perimeter rail surrounding the plurality of coil springs.

9. The adjustable mattress of claim 8, wherein the plurality of coil springs comprise a plurality of individual pocket coils.

10. The adjustable mattress of claim 9, wherein the plurality of coil springs comprise at least two sections of coil springs, each of the two sections separated by a spacer.

11. The adjustable mattress of claim 10, wherein the spacer comprises a plurality of individual foam coils.

12. The adjustable mattress of claim 8, wherein the foam perimeter rail comprises a plurality of individual sections of foam material providing a flexible perimeter surrounding the plurality of coil springs.

13. The adjustable mattress of claim 8, wherein the foam perimeter rail comprises perimeter side rails each formed from a plurality of individual foam coils.

14. The adjustable mattress of claim 13, wherein the foam perimeter rail comprises head and foot sections formed attached between the perimeter side rails.

* * * * *